US006937123B2

(12) United States Patent
Imanishi et al.

(10) Patent No.: US 6,937,123 B2
(45) Date of Patent: Aug. 30, 2005

(54) ELECTROMAGNETIC SWITCH OF ENGINE STARTER

(75) Inventors: Tomoya Imanishi, Kariya (JP); Youichi Hasegawa, Kasugai (JP); Sadayoshi Kajino, Nagoya (JP); Shuichi Aoki, Maebashi (JP)

(73) Assignees: Denso Corporation, Kariya (JP); Sawafuji Electric Co., Ltd., Tokyo (JP)

( * ) Notice: Subject to any disclaimer, the term of this patent is extended or adjusted under 35 U.S.C. 154(b) by 0 days.

(21) Appl. No.: 10/946,069

(22) Filed: Sep. 22, 2004

(65) Prior Publication Data

US 2005/0093665 A1 May 5, 2005

(30) Foreign Application Priority Data

Sep. 29, 2003 (JP) ..... 2003-337999

(51) Int. Cl.[7] ..... H01H 67/02
(52) U.S. Cl. ..... 335/126; 335/131
(58) Field of Search ..... 335/126, 131

(56) References Cited

U.S. PATENT DOCUMENTS 5,175,524 A * 12/1992 Gotoh ..... 335/126
5,424,700 A * 6/1995 Santarelli ..... 335/126
2002/0145494 A1 10/2002 Andoh et al. ..... 335/126

FOREIGN PATENT DOCUMENTS

JP A 2002-42627 2/2002

* cited by examiner

*Primary Examiner*—Ramon M. Barrera
(74) *Attorney, Agent, or Firm*—Oliff & Berridge, PLC

(57) ABSTRACT

An electromagnetic switch of an engine starter includes a pair of stationary contacts connectable to a starter motor, a movable contact disposed at a first distance from the pair of stationary contacts; a rod having one end that slidably supports the movable contact via an insulating member and a stopper that restricts axial movement of said movable contact, an electromagnetic coil unit that includes a plunger, a stator core, a spring that urges the movable contact against the stopper and an exciting coil which moves the rod by the plunger a second distance when excited, and an inclination rectifying member, disposed near the stationary contacts, for providing a rectifying surface disposed at a third distance from the movable contact to abut the movable contact when one of the stationary contacts wears to a preset degree. There is the following relationship between the first, second and third distances: the second distance>the third distance>the first distance.

6 Claims, 3 Drawing Sheets

ELECTROMAGNETIC SWITCH OF ENGINE STARTER

CROSS REFERENCE TO RELATED APPLICATION

The present application is based on and claims priority from Japanese Patent Application 2003-337999, filed Sep. 29, 2003, the contents of which are incorporated herein by reference.

BACKGROUND OF THE INVENTION

1. Field of the Invention

The present invention relates to an electromagnetic switch of an engine starter to be mounted in a vehicle.

2. Description of the Related Art

An engine starter for a vehicle usually includes an electromagnetic switch that turns on or off a power circuit for supplying electric power to a starter motor. JP-A-2003-35241 or U.S. 2002/0145494, a counter part of application, discloses such an electromagnetic switch, which includes a pair of bolt-like external terminals each having stationary contact at its inner end, a rod carrying a movable contact at its one end, a cylindrical exciting coil, a stationary care disposed inside the cylindrical exciting coil at one end thereof, a plunder disposed inside the cylindrical exciting coil at the other end thereof and coup springs disposed around the rod to exert spring force on the plunger. There movable contact us supported by the rod via an insulating member. When the exciting coup of the above electromagnetic switch is energized, the stationary core is magnetized to pull the plunder. As the plunger moves, the movable contact of the rod is brought in contact with the stationary contacts, so that the stationary contacts are electrically connected to close the power circuit.

If the exciting coil is deenergized thereafter, the plunger and the rod are pushed back by the coil springs, so that the movable contact leaves the stationary contacts to open the power circuit.

When the movable contact leaves the stationary contacts, an electric arc or a spark is generated and may cause damage or wear on the movable and stationary contacts. The wear of the stationary contacts, especially the wear of the positive side stationary contact is larger than others. Therefore, there arises a difference in height between the positive stationary contact and the negative stationary contact. Accordingly, the movable contact inclines when it contacts the stationary contacts, so that an offset load may be applied to the insulating member that is disposed between the movable contact and the rod. If the movable contact inclines much, the offset load may increase to a degree to break the insulating member. This problem may arise in case a vehicle is equipped with a system of engine-stopping-at-idling-operation (hereinafter referred to as the idling stop system), which stops an engine of a vehicle each time the vehicle temporarily stops at a traffic light or the like.

SUMMARY OF THE INVENTION

Therefore, the present invention is to provide an improved electromagnetic switch of an engine starter that can prevent the moving contact from inclining.

According to a main feature of the invention, an electromagnetic switch of an engine starter includes a pair of stationary contacts connectable to a starter motor, a movable contact disposed at a distance L2 from the pair of stationary contacts, a rod having one end that slidably supports the movable contact via an insulating member and a stopper that restricts axial movement of the movable contact, an electromagnetic coil unit that includes a plunger that moves the rod, a stator core, a spring that urges the movable contact against the stopper and an exciting coil that moves the plunger toward the stator core and moves the rod by a distance L1 in an axial direction when excited, and an inclination rectifying member, disposed near at least one of the stationary contacts, for providing a rectifying surface at a distance L3 from the movable contact to abut the movable contact when the same one of the stationary contact wears to a preset degree. In the above electromagnetic switch, the distances L1, L2 and L3 have the following relationship: L1>L3>L2.

According to another feature of the invention, the above electromagnetic switch further includes a resinous contact cover that accommodates the pair of stationary contacts and the movable contact therein, and the rectifying member is integrated with the contact cover.

According to another feature of the invention of the above electromagnetic switch, the rod is fixed to the plunger so that the rod and the plunger can move together. However, the rod may be linked with the plunger so that the rod and the plunger can move together after the plunger moves by a predetermined distance.

According to another feature of the invention, the above electromagnetic switch may further includes a sensor that provides a warning signal when the movable contact inclines to a predetermined degree. The sensor may be a pressure sensor or a temperature sensor that is disposed at a portion between the movable contact and the rectifying member.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 1:
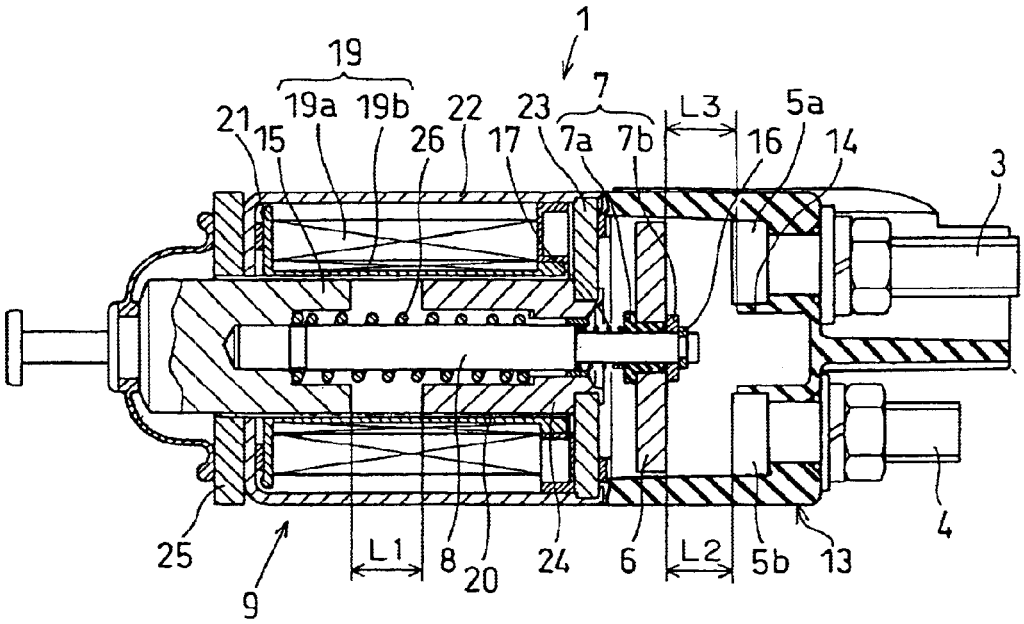
FIG. 1 is a cross-sectional longitudinal side view of an electromagnetic switch according to the first embodiment of the invention when the movable and stationary contacts thereof are opened.
Figures 3A, 3B, 3C, 3D:
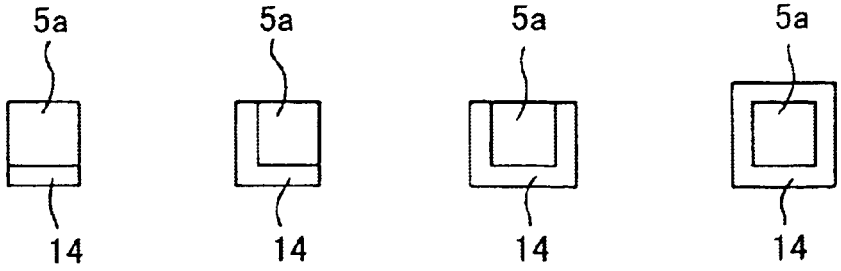
FIGS. 3A, 3B, 3C, 3D and 3E illustrates variations of an inclination rectifying member that surrounds one of the stationary contacts.
Figure 3E:
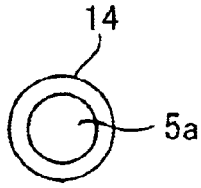
Figure 2:
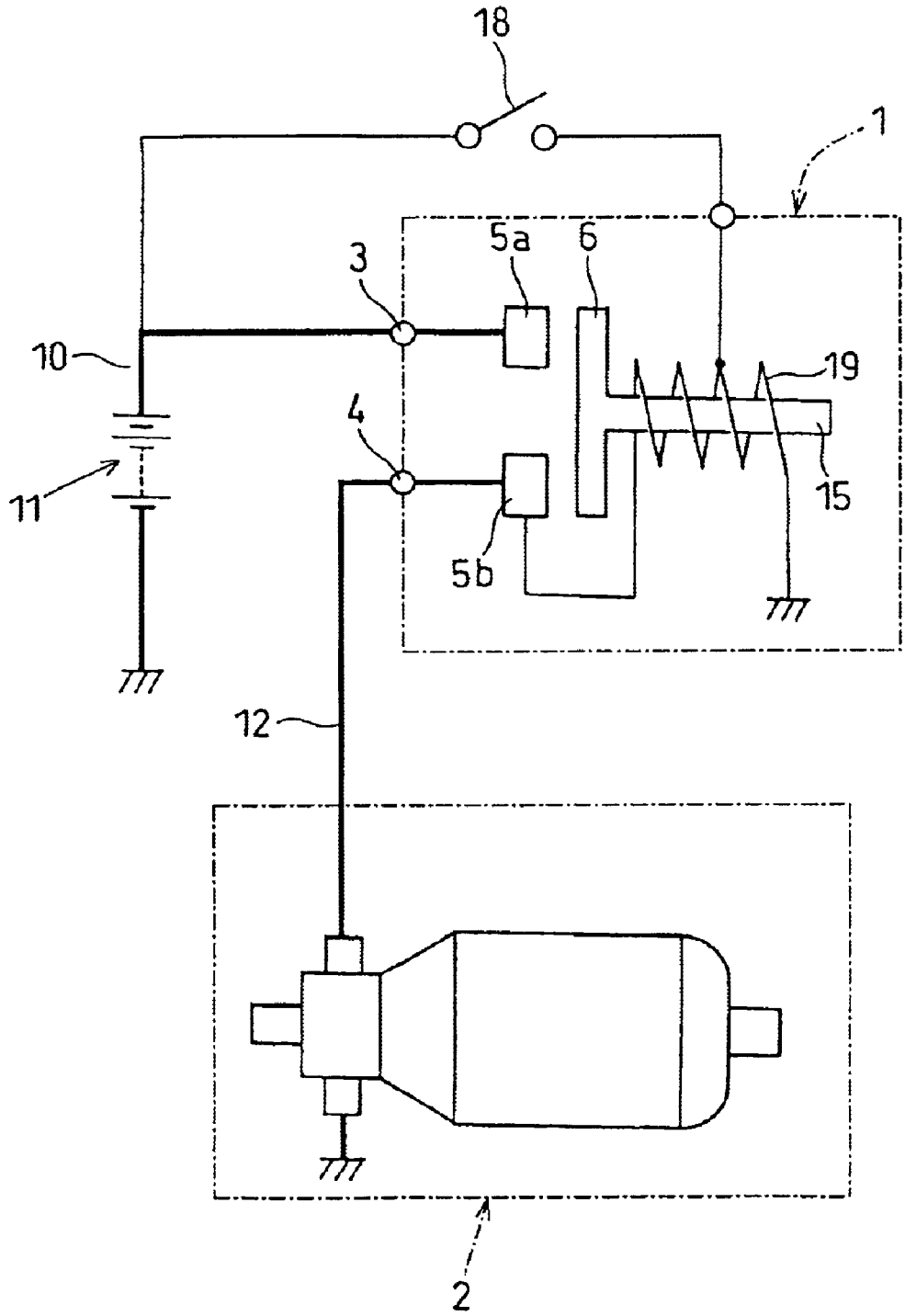
FIG. 2 illustrates a power circuit and a starter motor on which the electromagnetic switch is mounted.

An electromagnetic switch according to the first embodiment of the invention that is to be mounted on a starter motor 2, which is shown in FIG. 2, will be described with reference to FIGS. 1–4.

As shown in FIG. 1, the electromagnetic switch 1 has a pair of external electric terminals 3, 4, a pair of stationary contacts 5*a*, 5*b* each of which is integrated with one of the external electric terminals 3, 4, a movable contact 6, disposed opposite the stationary contacts 5*a*, 5*b*, a rod 8 which carries the movable contact 6 at one end via an insulating member 7, an electromagnetic coil unit 9 that pushes the rod 8 when energized and others.

As shown in FIG. 2, the terminal 3 is connected to the positive terminal of a battery 11 via a battery cable 10, and the terminal 4 is connected to the starter motor 2 via a motor lead wire 12. Accordingly, the stationary contact 5*a* becomes positive, and the stationary contact 5*b* becomes negative when the terminals 3 and 4 are respectively connected to the battery 10 and the starter motor 2. Both terminals 3 and 4 are fixed to a bottom of a cylindrical resinous contact cover 13, which is fixed to the electromagnetic coil unit 9.

The movable contact 6 is a conductive disk plate that has a center hole. The movable contact 6 is carried by the one end of the rod 8 via the insulating member 7. The insulating member 7 is comprised of a flanged cylindrical member 7*a* inserted in the center hole of the movable contact 6 and a ring member 7*b* that covers the central portion of the movable contact 6 on the side thereof confronting the stationary contacts 3, 4.

The rod 8 has an annular groove at the one end and a stopper or a circlip 16 that is fitted to the annular groove. The stopper 16 and the insulation member 7 fix the movable contact 6 in the axial direction. A contact spring 17 is disposed on the periphery of the rod 8 at the side of the movable contact behind the stopper 16 to urge the movable contact 6 via the insulating member 7 toward the stopper 16.

The electromagnetic coil unit 9 includes a plunger 15, an exciting coil 19, a stationary magnetic path member disposed around the exciting coil 19. The plunger 15 is disposed within the exciting coil 19 and has a cavity at its central portion, to which the other end of the rod 8 is force-fitted so that the rod can move together with the plunger 15. The stationary magnetic path member includes a cup-like cylindrical frame 22, a ground disk plate 23, a cylindrical stator core 24 and a bracket plate 25. The stationary magnetic path member provides a magnetic path to conduct magnetic flux generated by the exciting coil 19.

The electromagnetic switch 1 is designed, when the exciting coil 19 is not energized, so that a rod-moving distance L1 between plunger 15 and the stator core 24 is larger than a contact distance L2 between the movable contact 6 and the stationary contacts 5*a*, 5*b*, that is L1>L2.

The resinous contact cover 13 has a cylindrical outer member 13*a*, a cylindrical inner wall member 13*b* and an inclination rectifying member 14 that is integrally formed on an axial end of the inner wall member 13*b*.

The rectifying member 14 is an insulating member disposed within a reach of the movable contact 6 inside the contact cover 13. The rectifying member 14 projects in the axial direction of the contact cover 13 from the inner wall 13*b* along the inner side of the stationary contacts 5*a*, 5*b* to surround an end portion of the rod 8. In other words, the rectifying member 14 is disposed inside the contact cover 13 between the axis line of the rod 8 and the stationary contacts 5*a*, 5*b* so that the inner axial end surface of the rectifying member 14 comes radially inner side of the stationary contacts 5*a*, 5*b* and comes axially at a distance L3 from the surface of the movable contact 6, with L3 being the following relationship: L1>L3>L2. The rectifying member 14 is formed to abut or surround the stationary contact 5*a*, or 5*b*, which may be square, rectangular or round, as shown in FIGS. 3A–3E.

The exciting coil 19 includes a pulling coil 19*a*, a holding coil 19*b*, a sleeve 20 and a bobbin 21 that accommodates the pulling coil 19*a* and the holding coil 19*b* in two layers. The sleeve 20 is disposed between the bobbin 21 and the plunger 15. The cylindrical frame 22 accommodates the exciting coil 19.

The ground disk plate 23 has a center hole to which an end of the stator core 24 is fitted to magnetically connect to the ground disk plate 23. The cylindrical frame has an open end to which the outer periphery of the ground disk plate 23 is clamped and a bottom end to which the bracket plate 25 is fixed. The bracket plate 25 is to be fixed to a starter body, which is not shown.

The plunger 15, which is a movable magnetic core that composes a part of a magnetic circuit, is disposed inside the cylindrical sleeve 20 to confront the stator core 24 and urged by a return spring 26 in the direction opposite to the stator core 24. The plunger 15 is pulled by the stator core 24 and sticks to the same when the exciting coil 19 is energized to magnetize the stator core 24. On the other hand, the plunger 15 is pushed by the return spring 26 in the direction opposite to the stator core 24 when the exciting coil 19 is deenergized.

Therefore, when the plunger 15 is pulled together with the rod 8, the movable contact 6 contacts the pair of stationary contacts 5*a*, 5*b* before the rod 8 stops or the plunger 15 abuts the stator core 24, as long as the electromagnetic switch 19 is new. In other words, the rod 8 keeps moving after the movable contact 6 contacts the stationary contacts 5*a*, 5*b*, so that the movable contact 6 starts compressing the contact spring 17 and moves back relative to the rod 8. Therefore, the contact spring 15 absorbs or relieves the impacting shock of the movable contact 6, and the reaction force of the contact spring 15 is applied to the stationary contact 5*a*, 5*b* as contact pressure.

The electromagnetic switch 1 operates as follows.

When the starter switch 18 is turned on, the exciting coil 19 is energized to magnetize the stator core 24 and the plunger 15, so that the plunger 15 is pulled by the stator core 24. Consequently, the rod 8 moves right in FIG. 1, and the movable contact 6 contacts the pair of the stationary contacts 5*a*, 5*b*. Thereafter, the rod 8 further moves right so that the contact spring 17 can accumulate a reaction force until the plunger 15 abuts the end surface of the stator core 24. This reaction force provides a contact pressure between the movable contact 6 and the pair of stationary contacts 5*a*, 5*b*, so that the stationary contact 5*a* and the stationary contact 5*b* are connected to close the power circuit of the starter motor 2. As a result, starting current is supplied from the battery 11 to the starter motor 2.

When an engine has started, the starter switch 18 is turned off to cut the current supplied to the exciting coil 19. Accordingly, the pulling force exerted between the stator core 24 and the plunger 15 disappears, so that the plunger 15 is returned by the return spring 26. Consequently, the rod 8 moves left in FIG. 1, so that the movable contact 6 leaves the pair of stationary contacts 5*a*, 5*b*. As a result, the power circuit of the starter motor 2 is opened, and the electric supply of the starter motor 2 stops.

Figure 4:
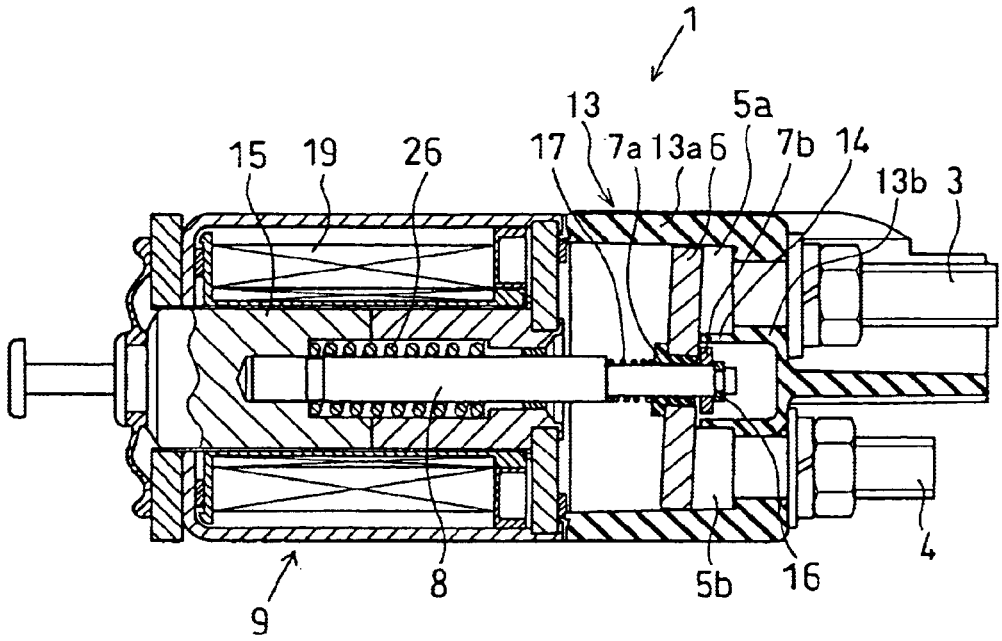
FIG. 4 is a cross-sectional longitudinal side view of the electromagnetic switch according to the first embodiment when the movable and stationary contacts are closed.

After the above operation is repeated many times, the positive side stationary contact 5*a* wears more than the negative side contact 5*b*, so that the movable contact 6 may incline when it contacts the pair of stationary contacts 5*a*, 5*b*. However, when the positive side contact 5*a* wears and its height (axial length) decreases to a preset level, the movable contact 6 abuts the rectifying member 14 disposed near the positive side contact 5*a*, as shown in FIG. 4. Therefore, further inclination of the movable contact 6 can be prevented.

Even if the stationary contact 5*a* wears out, the final distance L4 between the movable contact 6 and the stationary contact 5*a* will not become longer than L3. Therefore, the moving distance of the rod 8, which is the rod-moving distance L1, is always longer than L4. That is, the rod 8 moves by the rod-moving distance L1 when the exciting coil 19 is energized, the movable contact 6 moves backward relative to the rod 8 by a distance ΔL=L1−L4. Therefore, a reaction force is accumulated by the contact spring 17, so that the contact pressure between the movable contact 6 and the pair of stationary contacts can be always provided.

When electric supply to the exciting coil 19 is stopped, the plunger 15 and the rod 8 are pushed back. The movable contact 6 leaves the stationary contacts 5*a*, 5*b* after the rod 8 has moved back by the distance Δ L when the stopper or circlip 16 collides with the insulation ring member 7*b*. This impacting shock is effective for the movable contact 6 to leave the stationary contacts 5*a*, 5*b*. Thus, even if the positive side contact 5*a* has worn away to be as high as the rectifying member 14, the movable contact 6 can surely leave the stationary contact 5*a* whenever the starting switch 18 is turned off.

The rectifying member 14, which is unitary formed with the contact cover 13, can be separately provided.

Figure 5:
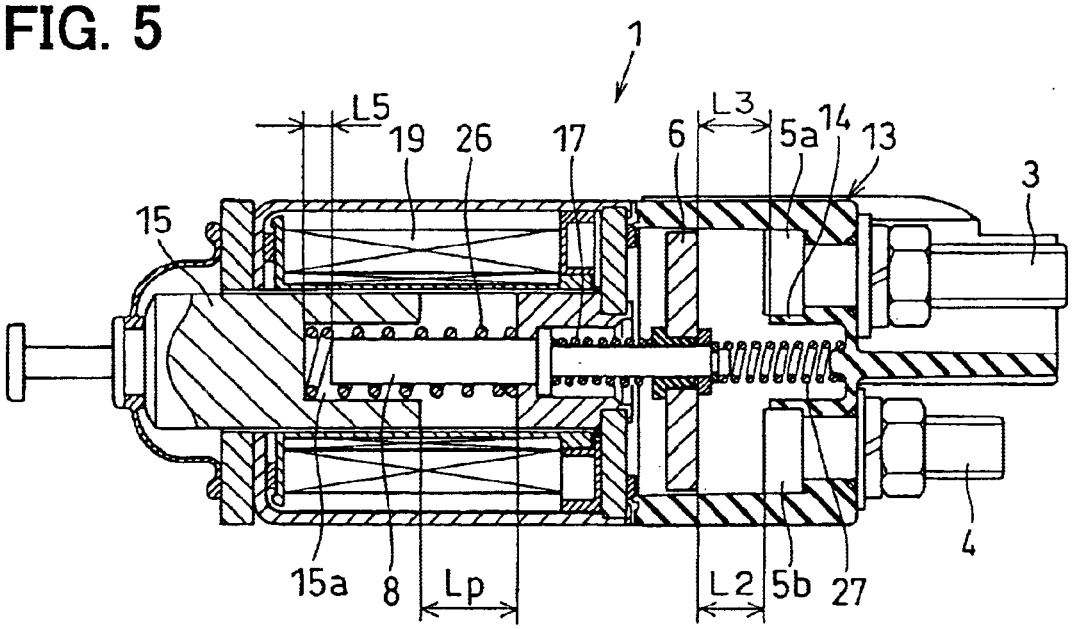
FIG. 5 is a cross-sectional longitudinal side view of the electromagnetic switch according to the second embodiment when the movable and stationary contacts are opened.

An electromagnetic switch 1 according to the second embodiment of the invention will be described with reference to FIG. 5.

Although the plunger 15 has a cavity at its central portion, the left end of the rod 8 is disposed at a distance L5 right from the plunger 15 and is not fixed to the plunger 15 as in the first embodiment. Therefore, the rod does not move together with the plunger 15 until the plunger 15 is driven to move right by a distance L5. That is, the rod 8 moves a rod-moving distance L1 while the plunger moves a plunger-moving distance Lp that is L5 longer than L1. This embodiment has another spring 27 that pushes the rod 8 against the right end thereof when the exciting coil 19 is deenergized. The rectifying member 14 is provided in the same manner as the first embodiment.

An inclination sensor may be disposed at the surface of the rectifying member 14. The inclination sensor may be comprised of a pressure sensor such as a piezoelectric sensor. When the stationary contact 5*a* wears, the movable contact 6 abuts the pressure sensor, which provides a warning signal.

The inclination sensor may be comprised of a temperature sensor that senses heat generated at the movable contact 6. As the stationary contact 5*a* wears more, the gap between the stopper 16 and the insulation ring member 7*b* becomes smaller. This decreases the reaction force of the contact spring 17 and increases the electric resistance of contact between the movable contact 6 and the stationary contacts 5*a*, 5*b*, resulting in that Joule heat increases to rise temperature of the movable contact 6. Thus, the warning signal is provided by the temperature sensor.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. An electromagnetic switch of an engine starter including a starter motor, said electromagnet switch comprising:

a pair of stationary contacts connectable to the starter motor;

a movable contact disposed at a distance L2 from said pair of stationary contacts;

a rod having one end that slidably supports said movable contact via an insulating member and a stopper that restricts axial movement of said movable contact;

an electromagnetic coil unit that includes a plunger that moves said rod, a stator core, a spring that urges said movable contact against said stopper and an exciting coil that moves said plunger toward said stator core and moves said rod by a distance L1 in an axial direction when excited; and an inclination rectifying member, disposed near at least one of said stationary contacts, for providing a rectifying surface at a distance L3 from said movable contact to abut said movable contact when said one of the stationary contact wears to a preset degree; wherein:

the distances L1, L2 and L3 have the following relationship: L1>L3>L2.

2. The electromagnetic switch as claimed in claim 1, further comprising a resinous contact cover that accommodates said pair of stationary contacts and said movable contact therein, wherein said rectifying member is integrated with said contact cover.

3. The electromagnetic switch as claimed in claim 1, wherein said rod is fixed to said plunger so that said rod and said plunger can move together.

4. The electromagnetic switch as claimed in claim 1, wherein said rod is linked with said plunger so that said rod and said plunger can move together after said plunger moves by a predetermined distance.

5. The electromagnetic switch as claimed in claim 1, wherein said inclination rectifying member has a portion that abuts said pair of stationary contacts and surrounds an end of said rod.

6. An electromagnetic switch of an engine starter including a starter motor, said electromagnet switch comprising:

a contact cover;

a pair of stationary contacts fixed to said contact cover to be connectable to the starter motor;

a movable contact disposed to confront said pair of stationary contact at a first span in which said movable contact can move to contact said pair of stationary contacts;

a rod having one end that slidably supports said movable contact;

an electromagnetic coil unit that includes a plunger connected to said rod, a stator core fixed to said contact cover, a spring disposed on said rod to elastically support said movable contact and an exciting coil that moves said plunger toward said stator core, said rod is disposed at a second span in which said rod can press said movable contact against said pair of stationary contacts when excited;

an inclination rectifying member for providing a rectifying surface at a third span in which said movable contact can abut said rectifying surface when said one of the stationary contact wears to a preset degree;

wherein: the first, second and third distances have the following relationship: the second span>the third span>the first span.

* * * * *